US008083360B2

(12) United States Patent
Bartlett

(10) Patent No.: US 8,083,360 B2
(45) Date of Patent: Dec. 27, 2011

(54) HAND HELD REAR VIEW MIRROR

(76) Inventor: Kevin Bartlett, Weare, NH (US)

( * ) Notice: Subject to any disclaimer, the term of this patent is extended or adjusted under 35 U.S.C. 154(b) by 0 days.

(21) Appl. No.: 12/185,311

(22) Filed: Aug. 4, 2008

(65) Prior Publication Data

US 2009/0034102 A1 Feb. 5, 2009

Related U.S. Application Data

(60) Provisional application No. 60/953,548, filed on Aug. 2, 2007.

(51) Int. Cl.
*G02B 5/10* (2006.01)
*G02B 7/182* (2006.01)

(52) U.S. Cl. ..... 359/868; 359/879

(58) Field of Classification Search ..... 359/868, 359/871, 872, 879, 880, 881
See application file for complete search history.

(56) References Cited

U.S. PATENT DOCUMENTS

| | | | | | |
|---|---|---|---|---|---|
| 468,149 | A | | 2/1892 | Frank | |
| 524,419 | A | * | 8/1894 | Gray | 359/865 |
| 1,139,560 | A | | 5/1915 | Mosher | |
| 1,439,836 | A | * | 12/1922 | Pease | 359/879 |
| 1,499,175 | A | | 6/1924 | Holquist | |
| 1,540,409 | A | * | 6/1925 | McCray | 359/855 |
| 1,584,205 | A | | 5/1926 | Zaldo | |
| 1,607,985 | A | | 11/1926 | Johnson | |
| 1,612,055 | A | | 12/1926 | Rice | |
| 1,823,814 | A | | 9/1931 | Aiello | |
| 2,265,094 | A | | 12/1941 | Wolfe | |
| 2,627,785 | A | | 2/1953 | Bartkowski | |
| 3,717,403 | A | | 2/1973 | Messier | |
| D236,458 | S | | 8/1975 | Sargis | |
| 4,054,375 | A | | 10/1977 | Ribeca | |
| 4,257,680 | A | * | 3/1981 | Baczkowski | 359/879 |
| 4,863,239 | A | | 9/1989 | Malone | |
| 5,361,169 | A | * | 11/1994 | Deal | 359/838 |
| 5,373,584 | A | | 12/1994 | Parcells, III | |

(Continued)

FOREIGN PATENT DOCUMENTS

DE 1 9827151 9/1999

(Continued)

OTHER PUBLICATIONS http://www.aerocorsair.com/id52.t.htm, Rear View Mirror, Mike Nowland, 5 pages, Nov. 20, 2006.

*Primary Examiner* — Ricky Shafer
(74) *Attorney, Agent, or Firm* — Bourque and Associates, PA

(57) ABSTRACT

A hand held mirror includes a body having a first and second body portion. The second body portion is arranged at a variable angle of between 0 and 50 degrees from the plane of the first body portion. A convex mirror is attached to the underside of the second body portion such that when the hand-held mirror is attached to the body of the user and raised or tilted slightly, the user has a view of the activities behind the user. The hand-held mirror may be attached to a piece of clothing or other article worn by the user including a glove or strap worn around the hand or lower wrist of the user. In addition, the hand-held mirror may include an additional device such as a watch, temperature gauge, altimeter, cell phone, radio, GPS, heart rate monitor, mapping device or turn signal indicator.

3 Claims, 3 Drawing Sheets

U.S. PATENT DOCUMENTS

| | | | | |
|---|---|---|---|---|
| 5,530,588 | A | 6/1996 | Vivier | |
| 5,609,529 | A | 3/1997 | Brown | |
| 5,694,261 | A | 12/1997 | Deal | |
| D424,783 | S | 5/2000 | Meier | |
| 6,120,157 | A | 9/2000 | Westover | |
| D478,399 | S | 8/2003 | Mishler et al. | |
| 7,063,427 | B1 | 6/2006 | Cutler | |
| 2005/0034212 | A1 | 2/2005 | Eisenbraun | |
| 2008/0259477 | A1 * | 10/2008 | Gorton et al. | 359/879 |

FOREIGN PATENT DOCUMENTS

| | | | |
|---|---|---|---|
| DE | 19949392 A1 | * | 4/2001 |
| FR | 2642181 | | 7/1990 |
| JP | 3264003 | | 11/1991 |
| JP | 9164983 | | 6/1997 |
| JP | 2000-39482 | * | 2/2000 |
| JP | 2007-56435 | * | 3/2007 |

* cited by examiner

HAND HELD REAR VIEW MIRROR

CROSS-REFERENCE TO RELATED APPLICATION

The present application claims priority from U.S. provisional patent application 60/953,548 filed Aug. 2, 2007 entitled "Hand Held Rear View Mirror" incorporated fully herein by reference.

TECHNICAL FIELD

The present invention relates to rearview mirrors and more particularly, relates to hand-held rearview mirrors which can be worn on the arm or wrist of the user for situations such as bicycling, rollerblading and the like.

BACKGROUND INFORMATION

Various forms of fixed or in-place rearview mirrors are used on various motorized vehicles such as motorcycles, motor scooters, bicycles, snowmobiles and the like. The rearview mirrors allowed the operator to monitor the activities behind the motorized vehicle.

For many applications, however, it is not feasible to have a fixed or in-place rearview mirror. This is particularly true for a bicycle due to the various height or positions required to pedal and coast a bicycle.

Other potential users of a rearview mirror do not have the ability to permanently mount a mirror. Such is the case, for example, for a jockey on a horse; a sailor, hang glider pilot or even a marathon runner. It would be advantageous for such users to be able to monitor his or her immediate "backspace" in order to avoid accidents with pursuing or overtaking competitors or to avoid dangerous traffic situations while at the same time not having to turn one's head to monitor the situation occurring behind the user.

Accordingly, a need exists for a small, portable, lightweight, easy to use rearview mirror that can be used in any situation wherein the user wishes to monitor that which is occurring behind the user.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
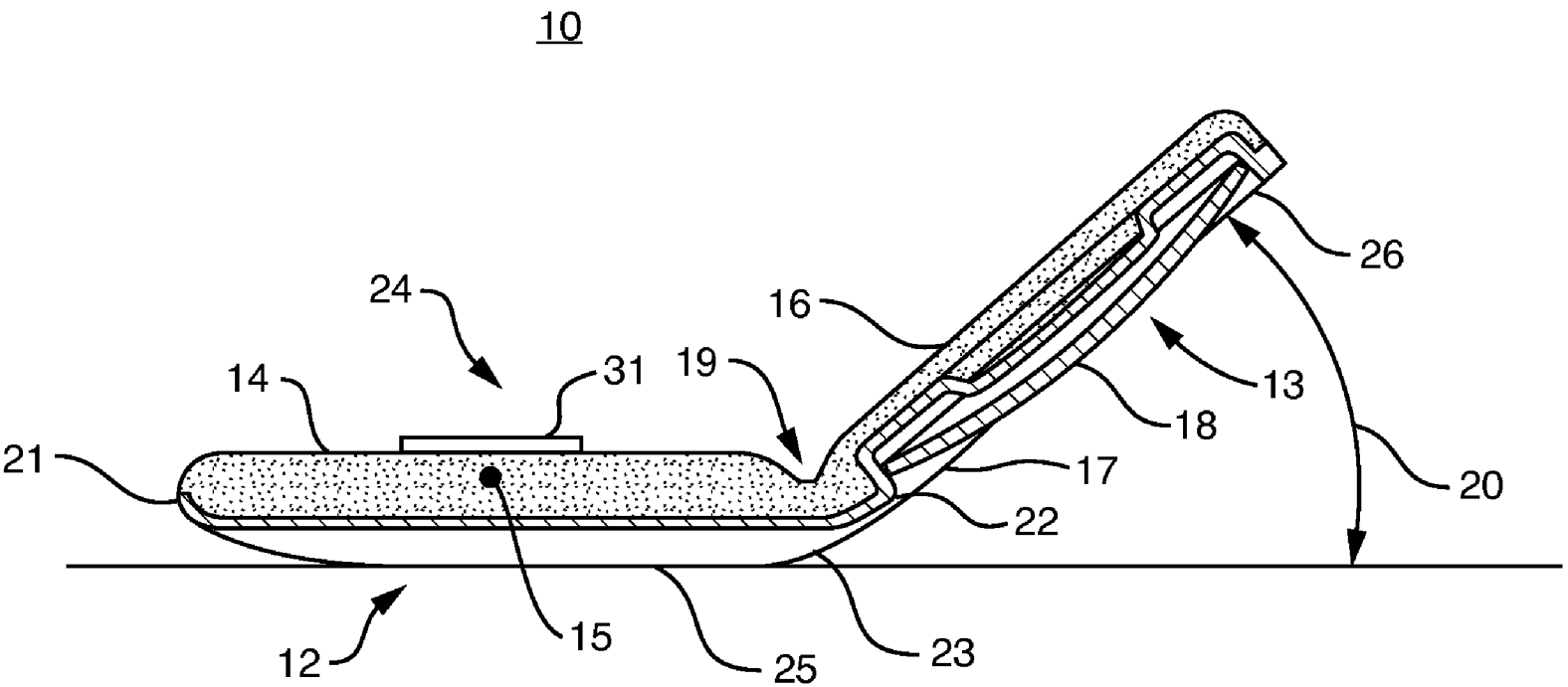
FIG. 1 is side schematic view of a hand-held rearview mirror in accordance with the teachings of the present invention.

The present invention features a hand-mounted mirror 10, FIG. 1. The hand-mounted mirror 10 includes a case or body portion 12 comprised of a first body portion 14 and a second body portion 16. A convex mirror 18 is mounted either permanently or temporarily on the second body portion 16. The first and second body portions may be straight or at an angle relative to one another. For exemplary purposes only, it is contemplated that the second body portion 16 be angled from between 0 to 50 degrees from the plane of the first body portion 14 based on the user, the activity for which the mirror will be used and/or the length or type of mirror. For example, when the hand-held mirror of the present invention is used for bicycling, an angle of at or near 0° has been shown to be preferably, although this is not a limitation of the present invention. In another embodiment, it is contemplated that the second body portion 16 can be approximately 40° from the plane of the first body portion 14 as shown generally by arrow 20. Accordingly, the second body portion 16 can be at a fixed or adjustable angle. In addition, it is preferred that the second body portion 16 be slightly longer than the first body portion 14 to allow for mounting of the convex mirror 18 and for use of the mirror.

The body portion 12 is preferably made of a rigid or semi-rigid plastic material as a one-piece body portion having a thin hinged like portion 19,22 at the connecting point between the first body portion 14 and the second body portion 16. The top area 24 of the body portion 12 preferably includes a foam "over mold" which is a thin self-skinning, low durometer foam of approximately 0.20 inches thick. The convex mirror 18 may be mounted to the second body portion 16 by a snap fit configuration or a double-sided adhesive material. The bottom region 24 of the first body portion 14 is adapted to be attached to the arm, wrist, or hand of a user by means of a glove, strap or the like. In addition, the top surface of the first body portion 14 or second body portion 16 may include an additional device 31 such as a watch, a temperature gauge, an altimeter, a cell phone, a radio, a GPS, a heart rate monitor, a map device and a turn signal indicator. The turn signal indicator may be mounted proximate the backside of the second portion 16 near the convex mirror 18.

Figure 2:
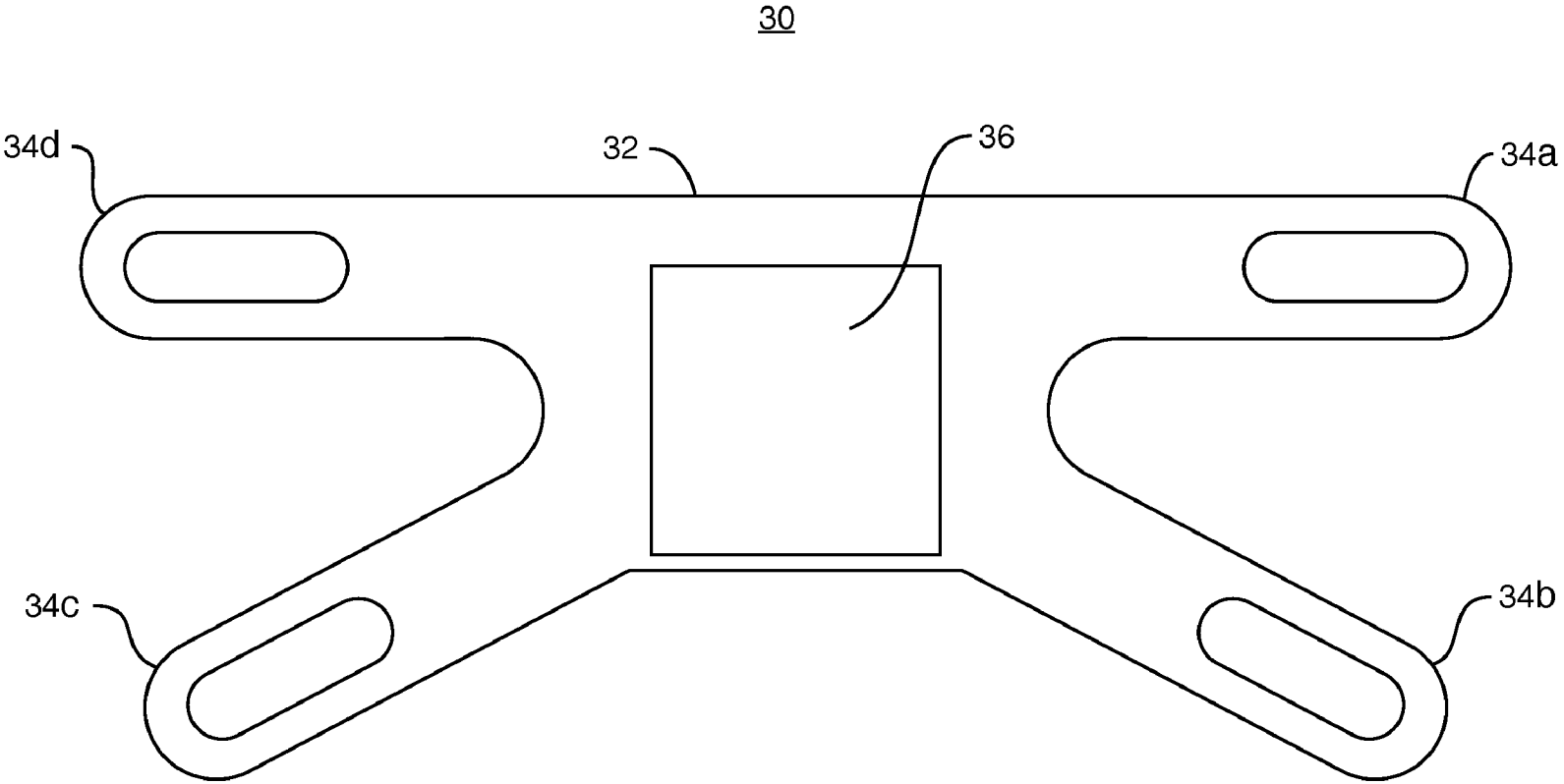
FIG. 2 is a schematic diagram of a hand mounting strap for use with the hand-held mirror in accordance with the teachings of the present invention.

The preferred embodiment of the present invention contemplates a wrist strap 30, FIG. 2, having a central region 32 and four outwardly extending regions 34. The four outwardly extending regions 34*a*-34*d* may include a fastening mechanism such as a hook/loop fastener system to allow the four extending regions 34 to wrap around and fasten to the hand of the user as will be shown in greater detail below. In addition, the central region 32 may include a fastening region 36 which may be configured to interface with the bottom region 24 of the first portion 14 of the hand-held mirror to generally secure the hand-held mirror 10 in place against the strap and on the hand of a user.

It is contemplated that the central region 32 will be approximately 3½ inches wide and each of the outwardly extending regions 34 will be approximately 1 inch wide. The overall width of the strap is approximately 10 inches.

Figure 4:
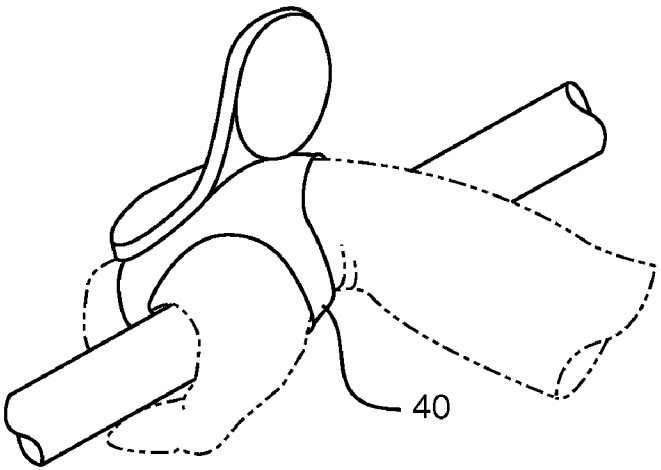
FIG. 4 is a schematic view of the hand-held mirror of the present invention mounted to a user's hand and shown in the use position.
Figure 3:
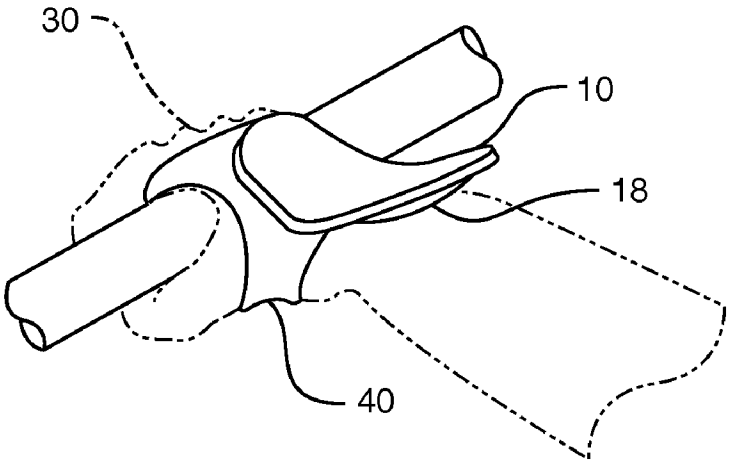
FIG. 3 is a schematic view of a hand-held mirror in accordance with the present invention mounted to a user's hand in a non-use position, utilizing a mounting strap also in accordance with the present invention.

In use, the hand-held mirror 10, FIG. 3, is temporarily or permanently attached to the hand strap 30 which in turn is attached to the hand 40 of the user below the wrist or to the lower wrist which will tilt up when the wrist is tilted upward. As shown in FIG. 3, a first position of the user's wrist 40 places the convex mirror 18 in a position that does not allow for the mirror to be extremely useful. However, by merely bending the wrist 40, FIG. 4, the user pivots or raises the second body portion 16 containing the convex mirror 18 about stationary axis 15, FIG. 1, allowing the user to see behind him or her.

As is evident, the hand-held mirror in accordance with the present invention need not necessarily be used with a strap in accordance with the configuration disclosed herein. As will be evident to those skilled in the art, the hand-held mirror 10 may be configured to attach to a piece of clothing, a glove, and armband or other suitable clothing item or accessory which permanently or allows the user to place the convex mirror 18 in a position that allows the user to see behind him or herself.

Accordingly, the hand-held mirror in accordance with the teachings of the present invention may be utilized by bicyclists, motorcycle riders, horseback riders, snowmobile riders, skate borders, roller bladers, walkers, joggers, skiers or in short, in any activity in which the user may want to see behind him or herself. In addition, other devices may be added to the topside or interior of the handheld mirror such as, but not limited to, a watch; temperature gauge, altimeter; cell phone; radio; GPS; heart rate monitor; map device; and turn signal or directional.

Modifications and substitutions by one of ordinary skill in the art are considered to be within the scope of the present invention, which is not to be limited except by the allowed claims and their legal equivalents.

The invention claimed is:

1. A hand-held mirror configured for attaching to a user's hand or wrist, comprising:

a single piece body having a first (12) and a second (13) body portion, said single piece body constructed of a rigid or semi-rigid material, said first and second body portions each having a first end region and a second end region, wherein said first end region of said first body portion (23) is attached to said first end region of said second body portion (17), said attachment defining a thin, hinge like region (19), whereby said first and second body portions are attached together at said thin, hinge like region (19), and wherein said first and second body portions are arranged at an angle of between approximately 0° to 50° (20) with respect to one another, each of said first and said second body portions having a front side (14, 16) facing outwardly away from a user when said hand held mirror is in use and attached to a user's hand or wrist and a back side (25, 26) facing inwardly toward said user when said hand held mirror is in use and attached to said user's hand or wrist, said first body portion (12) being a leading portion wherein said second end region (21) of said first body portion (12) is oriented facing a direction of travel of said user, and said second body portion (13) being a trailing portion wherein said second end region (23) of said second body portion (13) is oriented facing in a direction opposite said direction of travel;

a user attachment device, coupled to said first body portion, and configured for attaching said first body portion of hand-held mirror generally against and completely parallel to said user's hand or wrist; and a convex mirror (18), separate and apart from said first and second body portions, said convex mirror mounted on and disposed on and within a periphery defined by said back side (26) of said second body portion (13), said first and second body portions (12, 13) arranged and configured such that when the hand-held mirror is attached to said user's hand or wrist and not in use, said convex mirror (18) mounted on said back side (26) of said second body portion (13) is positioned facing and proximate said user's wrist and generally outside of a user's line of sight, and wherein said first and second body portions are arranged and configured such that when the hand-held mirror is attached to said user's hand or wrist, a slight downward tilting motion of said user's hand about a generally stationary axis is operable to cause said convex mirror (18) mounted on said back side (26) of said second body portion (13) to move upward and away from said position facing and proximate said user's wrist and places the convex mirror (18) in said user's line of sight to be able to see what is behind him or her without said user having to physically displace his or her hand from said generally stationary axis.

2. The hand-held mirror of claim 1, wherein said front side of said first body portion further includes an additional device mounted thereon.

3. The hand-held mirror of claim 2, wherein said additional device is selected from the group consisting of a watch, a temperature gauge, an altimeter, a cell phone, a radio, a GPS, a heart rate monitor, a map device and a turn signal indicator.

* * * * *